United States Patent [19]

Dubost et al.

[11] Patent Number: 4,752,343

[45] Date of Patent: Jun. 21, 1988

[54] AL-BASE ALLOYS CONTAINING LITHIUM, COPPER AND MAGNESIUM AND METHOD

[75] Inventors: Bruno Dubost, St. Egreve; Philippe Meyer, Voiron, both of France

[73] Assignee: Cegedur Societe de Transformation de l'Aluminum Perchiney, Paris, France

[21] Appl. No.: 710,691

[22] Filed: Mar. 11, 1985

[30] Foreign Application Priority Data

Mar. 15, 1984 [FR] France ..... 84 04482

[51] Int. Cl.[4] ..... C22F 1/04

[52] U.S. Cl. ..... 148/12.7 A; 148/159; 148/417

[58] Field of Search ..... 420/533, 534, 535; 148/159, 417, 439, 11.5 A, 12.7 A

[56] References Cited

U.S. PATENT DOCUMENTS 4,526,630 7/1985 Field ..... 148/159

FOREIGN PATENT DOCUMENTS 0088511 9/1983 European Pat. Off. .

OTHER PUBLICATIONS

E. A. Starke, Jr. et al., Aluminum-Lithium Alloys II, Proceedings of the Second International Aluminum-Lithium Conference, at Monterey, Calif., Apr. 12-14, 1983, pp. 255-285, 335-362, the Metallurgical Society of AIME.

*Primary Examiner*—R. Dean

*Attorney, Agent, or Firm*—Dennison, Meserole, Pollack & Scheiner

[57] ABSTRACT

The present invention relates to Al-base alloys essentially containing Li, Cu and Mg, and having high specific characteristics and a high degree of ductility. Their composition is as follows (% by weight):

| | | |
|---|---|---|
| Li | 1.7 to 2.9 | |
| Cu | 1.5 to 3.4 | with $0.5 \leqq \frac{Mg}{Cu} \leqq 0.8$ |
| Mg | 1.2 to 2.7 | |
| Fe | ≦ 0.20 | |
| Si | ≦ 0.06 | |
| Cr | 0 to 0.3 | |
| Mn | 0 to 1.0 | |
| Zr | 0 to 0.2 | |
| Ti | 0 to 0.1 | |
| Be | 0 to 0.01 | |
| Other elements (impurities) | | |
| each ≦ 0.05 | | |
| total ≦ 0.15 | | |
| balance: Al | | |

The heat treatment comprises a homogenization step at about $\theta$(°C.)=535-5 (% Mg) which practically dissolves the compounds Al-Cu (Li-Mg); a solution treatment at between $\theta+10°$ C.; a quenching step; and a tempering step at from 170° to 220° C. for a period ranging from 8 to 48 hours. The mechanical strength and ductility characteristics obtained are equivalent to those of conventional alloys 2000 or 7000.

16 Claims, 1 Drawing Sheet

AL-BASE ALLOYS CONTAINING LITHIUM, COPPER AND MAGNESIUM AND METHOD

Figure 1:
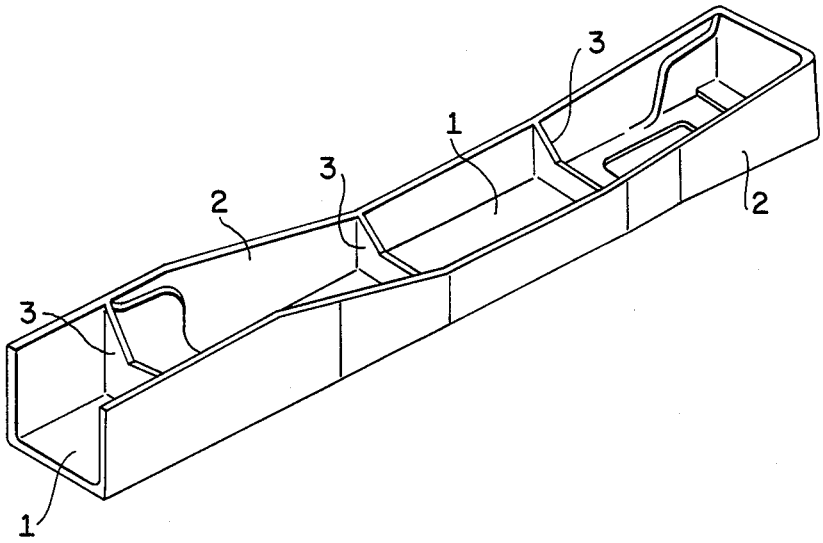

The present invention relates to Al-base alloys essentially containing Li, Cu and Mg, and having high specific characteristics and a high degree of ductility.

Metallurgists are aware that the addition of lithium reduces the density and increases the modulus of elasticity and mechanical strength of aluminium alloys. That explains the attraction from the point of view of designers of such alloys for uses thereof in the aeronautical industry and more particularly lithium-bearing aluminium alloys containing other additive elements such as magnesium or copper. However, such lithium-bearing alloys must necessarily have a degree of ductility and a level of toughness which are at least equivalent, with equal mechanical strength, to the value found in conventional aeronautical alloys such as alloys 2024-T4 or T351, 2214T6(51), 7175-T73 (51) or T7652 and 7150-T651 (using the Aluminium Association nomenclature), which is not the case with the known lithium-bearing alloys.

Recently, metallurgists have proposed novel compositions of aluminium-lithium alloys containing copper and magnesium, of low density and high specific mechanical strength; those are more particularly experimental alloys being the subject-matter of European patent application No. 88511 claiming alloys of the following nominal composition (% by weight): Li=2.0 to 2.8; Cu=1.0 to 1.5; Mg=0.4 to 1; Zr≦0.2; Mn≦0.5; Ni≦0.5; Cr≦0.5. The levels of strength and elongation which are attained using thin sheets in the state T8 and thick sheets in the state T651 are however still lower than those of the aeronautical alloys of the series 2000 to 7000, as for the other alloys of the AlLiCu and AlLiCuMg systems with a lithium content of higher than 1.7%, which are known to date, whether they are products obtained by ingot metallurgy (for example by semi-continuous casting) or by powder metallurgy.

In the course of metallurgical tests, we have discovered and experimented with novel compositions of industrial alloys of the system Al-Li-Mg-Cu (+Cr, Mn, Zr, Ti), which have higher levels of performance than the alloys of the systems AlLiCu and AlLiMg, and than the known alloys of the system AlLiCuMg, from the point of view of a compromise between mechanical strength and ductility.

The novel alloys according to the invention are of the following compositions by weight:

| | |
|---|---|
| Li 1.7 to 2.9% | |
| Cu 1.5 to 3.4% | with $0.5 \leqq \frac{Mg}{Cu} \leqq 0.8$ |
| Mg 1.2 to 2.7% | |
| Fe ≦ 0.20% | |
| Si ≦ 0.12% | |
| Cr 0 to 0.3% | |
| Mn 0 to 1.0% | |
| Zr 0 to 0.2% | |
| Ti 0 to 0.1% | |
| Be 0 to 0.02% | |
| other elements (impurities) | |
| each ≦ 0.05% | |
| total ≦ 0.15% | |
| balance: aluminium | |

The proportion of principal elements is preferably kept, on an individual or a combination basis, at from 1.7 to 2.5 in respect of Li, from 1.2 to 2.2% in respect of Mg and 1.7 to 3.0% in respect of Cu. The proportion of Zr is preferably from 0.10 to 0.18%.

The Cu content may be limited between 2 and 2.7%. The iron and the silicon content are held, preferably under 0.10 and 0.06% respectively.

To achieve the best compromise in regard to mechanical strength and ductility, the following relationship must also be observed:

$$\%Li(\%Cu+2)+\%Mg=K$$

with $8.5 \leqq K \leqq 11.5$ and preferably $9 \leqq K \leqq 11$.

The alloys according to the invention have their optimum level in regard to strength and ductility after homogenization treatment of the cast products and solution treatment in respect of the transformed products, including at least one stage at a temperature $\theta$ (in °C.) of the order of $\theta=535-5(\%Mg)$ for a sufficient period of time that, after quenching, the intermetallic compounds of the phases Al-Cu-(Li,Mg) which can be detected upon micrographic examination or by electronic or ionic microanalysis (SIMS) are preferably completely dissolved in the Al or are smaller than 5 μm in size. Homogenization may be effected in a temperature range of from $\theta+10$ (°C.) to $\theta-20$ (°C.); the solution treatment is preferably carried out at from $\theta \pm 10°$ C.

It was found that the alloys in which $K>11.5$ had an insufficient level of ductility and that the alloys in which $K<8.5$ were of inadequate mechanical strength.

The optimum periods of time for thermal homogenization treatment at the temperature $\theta$ are 0.5 to 8 hours for alloys produced by rapid solidification (atomization—splat cooling—or any other means) and from 12 to 72 hours for products which are cast or produced by a semi-continuous casting process.

Such alloys have their optimum mechanical properties after tempering operations of durations of from 8 to 48 hours at temperatures of from 170° to 220° C. (preferably from 180° to 200° C.), and it is preferable to subject the products, in appropriate form (sheets, bars, billets) to a cold working operation giving rise to a degree of plastic deformation of from 1 to 5% (preferably from 2 to 4%) between quenching and tempering, which permits the mechanical strength of the products to be further enhanced, without detrimentally affecting their ductility.

Under those conditions, the alloys according to the invention have a level of mechanical strength and ductility which is higher than the values of the well known alloy AlLiMgMn 01420 (Al—5%Mg—2%Li—0.6%Mn) and have a compromise as between mechanical strength and ductility, which is superior to that found in the known AlLiCuMg alloys (with small amounts of magnesium). They have moreover an excellent resistance to flaking corrosion.

Those alloys are therefore a particularly attractive proposition for the production of cast or rolled semifinished products (produced by semi-continuous casting, atomization or splat cooling, etc.), whether they are for example extruded, rolled, forged or die-stamped products.

The invention will be better appreciated and illustrated by reference to the drawings and the following Examples.

FIG. 1 is a perspective view of a die-stamped component, relative to Example 2 set out hereinafter.

EXAMPLE 1

Billets of $\phi$200 mm were cast by a semi-continuous process and have the analyses set out in Table I(a). Unless indicated to the contrary, the proportions of Fe and Si of the casting metals used are respectively lower than 0.04% and 0.03%. Those correspond to conventional alloys (C, D), or to a known lithium-bearing alloy (E), or to alloys according to the invention (A, F) or outside the invention (B). The billets were homogenized and extruded to form sections of $\phi 100 \times 13$ mm. They were then subjected to solution treatment, quenched with water and tempered under the conditions set forth in Table I(b). The results of the mechanical tensile characteristics, obtained in the long direction and the long transverse direction are set out in Table I(c).

TABLE I

Ia - Chemical compositions

| Casting Reference | Alloy | Proportions by weight % Li | % Cu | % Mg | % Mn | % Zr | % Ti | Others |
|---|---|---|---|---|---|---|---|---|
| A | According to the invention K = 9.6 | 1.90 | 2.38 | 1.30 | 0.01 | 0.12 | 0.01 | — |
| B | Outside the invention | 2.45 | 2.22 | 1.01 | 0.01 | 0.11 | 0.01 | — |
| C | 2024 | 0 | 4.38 | 1.33 | 0.75 | 0.11 | 0.02 | — |
| D | 7475 Fe = 0.05 Si = 0.03 | 0 | 1.32 | 2.36 | 0.02 | 0 | 0.02 | Cr = 0.21 Zn = 5.7 |
| E | F92 (DTDXXXA) | 2.28 | 1.32 | 0.75 | <0.01 | 0.14 | 0.04 | — |
| F | According to the invention (K = 10.0) | 2.05 | 2.13 | 1.57 | <0.01 | 0.12 | 0.02 | — |

Ib - Heat treatments

| Casting Reference | Homogenization | Solution treatment | Controlled traction | Tempering |
|---|---|---|---|---|
| A | 526° C. - 24 h | 530° C. - 2 h | 2% | 190° C. - 48 h |
| B | 535° C. - 24 h | 535° C. - 2 h | 2% | 190° C. - 48 h |
| C | 490° C. - 8 h | 495° C. - 2 h | 2.1% | T351 T7351 |
| D | 470° C. - 16 h | 475° C. - 2 h | 2.0% | 6 h 107° C. + 24 h 160° C. |
| E | 538° C. - 24 h | 538° C. - 2 h | 3.5% | 190° C. - 12 h |
| F | 527° C. - 24 h | 526° C. - 1.5 h | 2.0% | 190° C. - 48 h |

Ic - Mechanical tensile characteristics

| Casting Reference | Long direction Rp 0.2 (MPa) | Rm (MPa) | A % | Long transverse direction Rp 0.2 (MPa) | Rm (MPa) | A% | L.T.* KIc MPa $\sqrt{m}$ |
|---|---|---|---|---|---|---|---|
| A | 455 | 495 | 11.6 | 419 | 461 | 8.5 | 40 |
| B | 460 | 520 | 6.5 | 427 | 475 | 5.8 | 34 |
| C | 401 | 530 | 12.3 | 342 | 491 | 19.0 | 39 |
| D | 460 | 530 | 11.6 | 446 | 517 | 13.1 | 41 |
| E | 462 | 523 | 4.6 | 399 | 487 | 7.0 | 35 |
| F | 442 | 488 | 9.7 | 411 | 452 | 7.7 | 41 |

*Long direction for traction, transverse direction for crack propagation

The alloys according to the invention (A and F) have degrees of elongation which are greater than those of the known Li-bearing alloy (E) with equivalent elastic limits. The mechanical tensile characteristics obtained on the alloys A and F are moreover close to those of the conventional alloys.

EXAMPLE 2

Billets of $\phi$200 mm, whose chemical composition is set out in Table II(a) were cast by a semi-continuous process, homogenized and then transformed by extrusion and die-stamping into precision die-stamped components, the form of which is shown in FIG. 1. The latter comprise a flat rectangular bottom 1 with dimensions of $489 \times 70 \times 3$ mm, bordered on its two longitudinal edges and a transverse edge by three ribs 2 which are perpendicular to the bottom, being from 40 to 60 mm in height and from 3 to 5 mm in thickness, the longitudinal edges being separated by three small cross portions 3, 1.5 mm in thickness. The heat treatments carried out are set forth in Table II(b) and the results of the mechanical characteristics obtained in the long and long transverse directions are set forth in Table II(c).

TABLE II

IIa - Chemical compositions

| Casting Reference | Alloy | Proportions by weight % Li | % Cu | % Mg | % Mn | % Zr | % Ti | Others |
|---|---|---|---|---|---|---|---|---|
| A | According to the invention K = 9.6 | 1.90 | 2.38 | 1.30 | 0.01 | 0.12 | 0.01 | — |
| B | Outside the invention | 2.45 | 2.22 | 1.01 | 0.01 | 0.11 | 0.01 | — |
| G | Outside the | 2.68 | 1.36 | 0.92 | <0.01 | 0.10 | 0.01 | — |

TABLE II-continued

| | | | | | | | | |
|---|---|---|---|---|---|---|---|---|
| | invention | | | | | | | |
| F | According to the invention (K = 10.0) | 2.05 | 2.13 | 1.57 | <0.01 | 0.12 | 0.02 | — |
| H | 7175 | 0 | 1.43 | 2.47 | 0.02 | — | 0.02 | Zn = 5.85<br>Cr = 0.21<br>Fe = 0.17<br>Si = 0.08 |

IIb - Heat treatments

| Casting Reference | Homogenization | Solution treatment | Controlled traction | Tempering |
|---|---|---|---|---|
| A | 526° C. - 24 h | 530° C. - 2 h | no | 190° C. - 24 h |
| B | 535° C. - 24 h | 535° C. - 2 h | no | 190° C. - 24 h |
| G | 533° C. - 24 h | 533° C. - 1.5 h | no | 210° C. - 18 h |
| F | 526° C. - 24 h | 526° C. - 1.5 h | no | 190° C. - 12 h |
| H | 470° C. - 10 h | 475° C. - 2 h | no | 107° C. - 6 h<br>+175° C. - 8 h |

IIc - Mechanical tensile characteristics

| Casting 1 | Long direction | | | Long transverse direction | | |
|---|---|---|---|---|---|---|
| Reference | Rp 0.2 (MPa) | Rm (MPa) | A % | Rp 0.2 (MPa) | Rm (MPa) | A % |
| A | 488 | 590 | 10.2 | 450 | 561 | 10.8 |
| B | 495 | 598 | 6.5 | 462 | 553 | 7.2 |
| G | 507 | 582 | 5.0 | 446 | 528 | 7.2 |
| F | 484 | 583 | 9.8 | 492 | 555 | 10.2 |
| H | 485 | 555 | 10.8 | 471 | 490 | 10.7 |

This Example shows that the alloys according to the invention (A and F), on precision die-stamped components (not subjected to cold working between quenching and tempering), result in levels of mechanical strength and ductility which are at least equal to those of the alloy 7175 (H) normally used for that type of product, but of greater density.

We claim:

1. A heat treated and aged Al-base alloy of high strength and high ductility characterized in that it consists essentially of (in % by weight):

| | | |
|---|---|---|
| Li | 1.7 to 2.9 | |
| Cu | 1.5 to 3.4 | with $0.5 \leqq \frac{Mg}{Cu} \leqq 0.8$ |
| Mg | 1.2 to 2.7 | |
| Fe | ≦ 0.20 | |
| Si | ≦ 0.12 | |
| Cr | 0 to 0.3 | |
| Mn | 0 to 1.0 | |
| Zr | 0 to 0.2 | |
| Ti | 0 to 0.1 | |
| Be | 0 to 0.02 | |
| other elements (impurities) each ≦ 0.05 Total ≦ 0.15 | | |
| balance: aluminium | | |

2. An alloy according to claim 1 characterised in that it contains from 1.7 to 2.5% of Li.

3. An alloy according to claim 1 or claim 2 characterised in that it contains from 1.7 to 3% of Cu.

4. An alloy according to claim 3, characterised in that it contains from 2 to 2.7% of Cu.

5. An alloy according to claim 1 characterised in that it contains from 1.2 to 2.2% of Mg.

6. An alloy according to claim 1 characterised in that it contains at most 0.10% Fe and 0.06% Si.

7. An alloy according to claim 1 characterised in that:

$$\%Li(\%Cu+2)+\%Mg=K$$

ps with $8.5 \leqq K \leqq 11.5$.

8. An alloy according to claim 7 characterised in that $9 \leqq K \leqq 11$.

9. A process for the heat treatment of the alloy of claim 1 comprising a homogenization step, a solution treatment, a quenching step and a tempering step characterised in that the alloy is subjected to homogenization and solution treatment at a temperature (in °C.) of the order of $\theta = 535-5$ (%Mg).

10. A process according to claim 9 characterised in that the duration of the homogenization step and the solution treatment is sufficiently long that after the quenching operation the intermetallic phases of type Al-Cu-(Li,Mg) are of a size between 0 and 5 μm, inclusive.

11. A process according to claim 9 or claim 10 characterised in that the homogenization operation is carried out in the temperature range defined by $\theta+10$ (°C.) and $\theta-20$ (°C.).

12. A process according to claim 9 or claim 10 characterised in that the solution treatment is carried out in the temperature range defined by $\theta+10$ (°C.) and $\theta-10$ (°C.).

13. A process according to claim 9 or 10 characterised in that the tempering operation is carried out at from 170° to 220° C. for a period ranging from 8 to 48 hours.

14. A process according to claim 13 characterised in that the tempering operation is carried out at from 180° to 200° C.

15. A process according to claim 9 or 10 characterised in that a degree of plastic deformation of from 1 to 5% is applied to the treated product between the quenching and tempering operations.

16. A process according to claim 15, wherein said degree of plastic deformation is from 2 to 4%.

* * * * *